US005228219A

United States Patent [19]

Tonel

[11] Patent Number: 5,228,219

[45] Date of Patent: Jul. 20, 1993

[54] WATERPROOF DEVICE, PARTICULARLY FOR BOOTS

[75] Inventor: Valerio Tonel, Biadene, Italy

[73] Assignee: Nordica S.p.A., Montebelluna, Italy

[21] Appl. No.: 891,208

[22] Filed: Jun. 1, 1992

[30] Foreign Application Priority Data

Jun. 6, 1991 [IT] Italy ..... TV91U000020

[51] Int. Cl.[5] ..... A43B 5/04

[52] U.S. Cl. ..... 36/117; 36/50.5

[58] Field of Search ..... 36/117, 118, 119, 120, 36/121, 50.5

[56] References Cited

U.S. PATENT DOCUMENTS

| | | | |
|---|---|---|---|
| 3,483,638 | 12/1969 | Baso | 36/50.5 |
| 3,657,827 | 4/1972 | Rieker | 36/117 |
| 4,856,210 | 8/1989 | Delery | 36/117 |
| 4,974,346 | 12/1990 | Marega et al. . | |
| 4,999,933 | 3/1991 | Balbinot | 36/117 |
| 5,003,710 | 4/1991 | Pozzobon | 36/117 |
| 5,111,598 | 5/1992 | Sartor et al. | 36/117 |

FOREIGN PATENT DOCUMENTS

| | | | |
|---|---|---|---|
| 0278281 | 8/1988 | European Pat. Off. | 36/117 |
| 1915442 | 10/1970 | Fed. Rep. of Germany . | |
| 3431746 | 3/1985 | Fed. Rep. of Germany . | |
| 2379263 | 10/1978 | France | 36/117 |

*Primary Examiner*—David T. Fidei
*Assistant Examiner*—Marie D. Patterson
*Attorney, Agent, or Firm*—Guido Modiano; Albert Josif

[57] ABSTRACT

A waterproof device, for boots having a shell and/or a quarter which have a first and a second overlapping flaps. The device is constituted by an insert arranged at a seat defined on the first flap of the shell and/or of the quarter. The insert has containment seats for respective levers and a tab which can be sealingly interposed between the first flap and the second flap.

6 Claims, 3 Drawing Sheets

WATERPROOF DEVICE, PARTICULARLY FOR BOOTS

BACKGROUND OF THE INVENTION

The present invention relates to a waterproof device particularly usable for ski boots of the type with overlapping flaps.

Currently, a known type of overlap-style ski boots is constituted by a shell which has overlapping flaps and in which a transverse slot is defined in the region adjacent to the tip of the boot; an element, such as a rubber insert, is sealingly accommodated in said slot.

Said known type of overlap-style boot is not free from problems: first of all, the rubber insert is not sufficient to ensure complete tightness with regard to water infiltrations, since water can penetrate at the longitudinal sides of the flaps.

The accumulation of snow at the longitudinal sides of the flaps is also facilitated by the protrusion of the securing elements with respect to the surface of the shell and of the quarter.

The overlap of the flaps furthermore increases the protrusion of the securing elements, which are subject to opening or breakage due to accidental impacts with the ground.

Japanese Patent Application No. 1-80002 (Mizuno) discloses a ski boot having a small insert on the tip of the shell. The insert only has a limited protection on the frontmost lever and possibly prevents water from infiltrating at the tip of the boot.

The insert shown by Mizuno is clearly not adapted to protect the levers on the shell and to prevent water from infiltrating at the side of the shell.

SUMMARY OF THE INVENTION

The aim of the present invention is therefore to eliminate the problems described above in known types by providing a device which allows to achieve optimum tightness with regard to weather factors such as snow and water.

Within the scope of the above aim, an important object is to provide a device wherein the overlap of the flaps does not increase the protrusion of the securing elements with respect to said flaps.

Another important object is to provide a device wherein the securing elements, such as levers, do not protrude beyond the outer lateral surface of the shell and/or of the quarter.

Another important object is to provide a device which is structurally simple and easy to industrialize.

Not least object is to provide a device which is reliable and safe in use and has modest manufacturing costs.

This aim, these objects and others which will become apparent hereinafter are achieved by a waterproof device, particularly for boots comprising either one of a shell and a quarter provided with a first flap and with a second flap which mutually overlap, characterized in that it comprises an insert engaged at a seat provided on either one of said shell and said quarter, having at least one containment seat for a lever and a tab interposed between said first flap and said second flap.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figure 1:
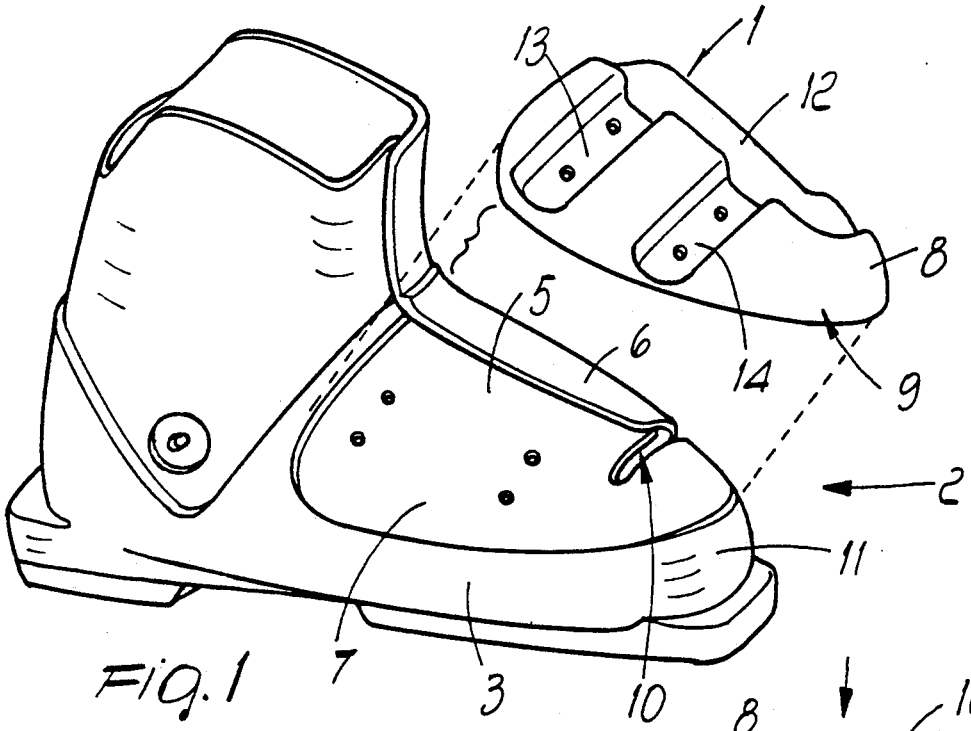
FIG. 1 is an exploded view of the waterproof device applied to a shell with overlapping flaps.
Figure 2:
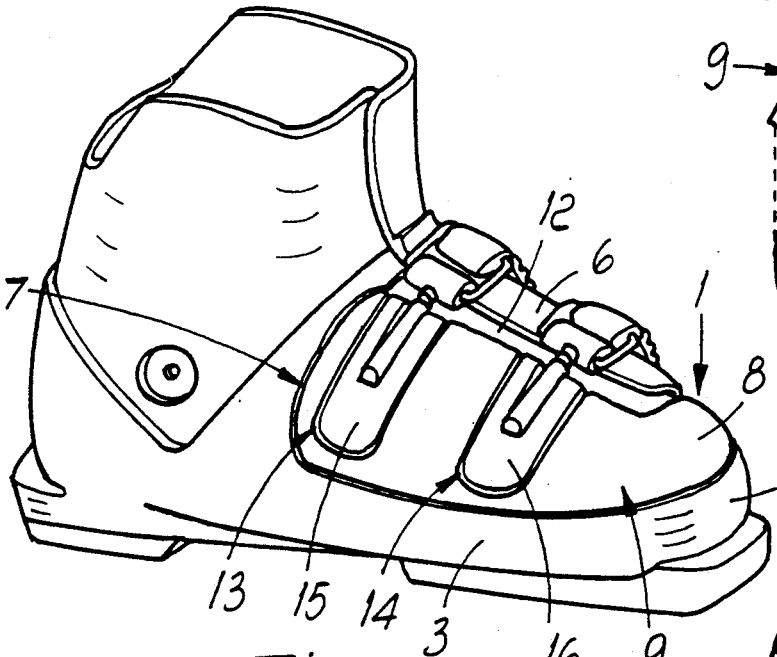
FIG. 2 is a perspective view of the device, associated with the shell.
Figure 3:
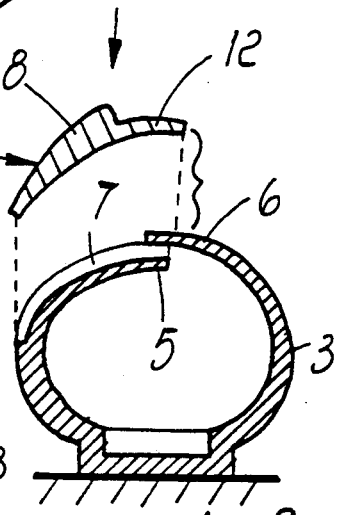
FIG. 3 is a sectional exploded view of the device, taken along a transverse median plane.
Figure 4:
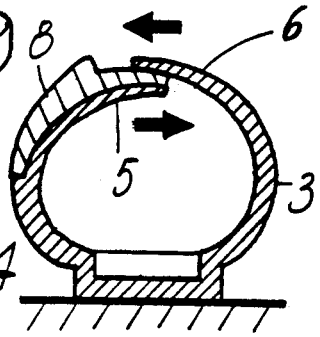
FIG. 4 is a view, similar to the preceding one, of the device with the insert associated with the shell.

With reference to the above figures, the waterproof device, generally designated by the reference numeral 1, is particularly usable in ski boots 2,102 which have a shell 3,103 and/or a quarter 104 of the type which comprises a first flap 5 and a second flap 6 which mutually overlap.

Figures 5, 6:
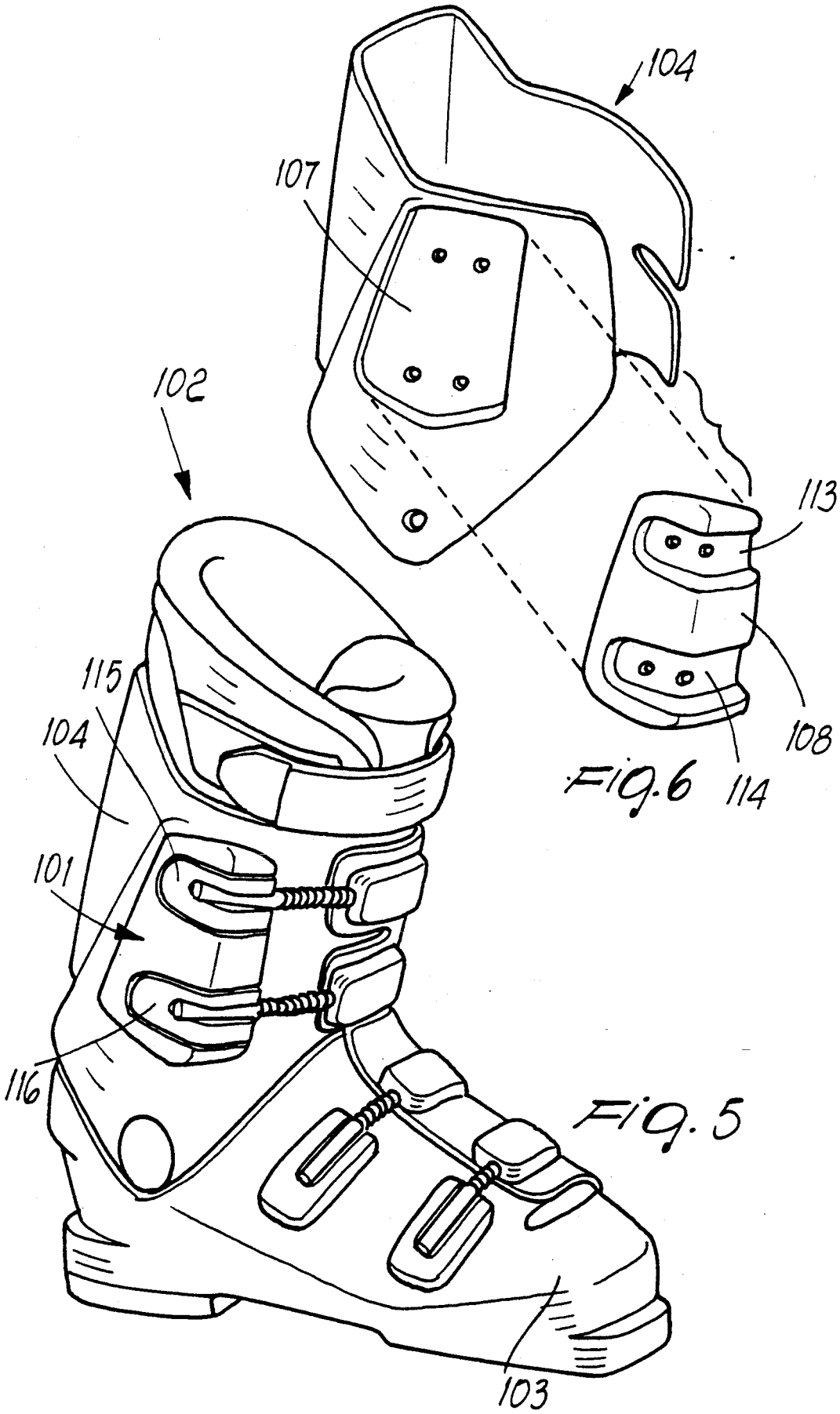
FIG. 5 is a view, similar to the view of FIG. 1, of the waterproof device applied to the quarter.
FIG. 6 is an exploded view of the device according to the preceding figure.

The boot 2,102 has, at said shell 3 and/or at said quarter 104 and preferably on said first flap 5, a first seat 7,107 which affects the entire region of the shell 3 on which the first flap 5 and the second flap 6 are located and/or the region of said quarter 104 (FIG. 6) on which the levers are arranged.

The waterproof device can be associated at the first seat 7,107 and is constituted by an insert 8,108 which is shaped complementarily to the first seat 7,107.

When in use, the outer lateral surface 9 of said insert 8 is flush with the corresponding adjacent surface of said shell 3 and/or of said quarter 104.

The insert 8 also completely conceals the transverse slot 10 which is defined at the end of the first flap and of the second flap which is adjacent to the tip 11 of the shell 3.

The insert 8, which is preferably made of rubber or of an elastically compressible material, is provided, approximately at the region affected by the second flap 6, with a tab 12 which can be sealingly interposed between the facing surfaces of the first flap and of the second flap.

The insert 8,108 has, at the region which overlaps the first seat 7,107, a second seat 13,113 and a third seat 14,114 which are arranged approximately parallel to one another along a plane which is transverse to said shell or boot.

The second and third seats 13,113 and 14,114 are suitable for accommodating securing elements such as a first lever 15,115 and a second lever 16,116.

The levers are flush with the adjacent outer lateral surface 9 of said insert 8

Once the various components have been assembled, the waterproof device 1 thus allows to assure, when the securing elements are activated, an optimum tight seal against water by virtue of the interposition of the tab 12 of the insert 8 between the first flap 5 and the second flap 6.

The operation of the above described device is as follows: when the boot 2 is in use, once both the first flap 5, with which the insert 8 is associated, and the second flap 6 have been spaced, the user can insert his foot in the boot.

The user then exerts a lever action on the securing elements, thus closing the boot 2 by means of the partial overlap of the first and second flaps 5 and 6, with compression of the tab 12.

Advantageously, once both the first lever 15,115 and the second lever 16,116 have been secured, they retract into their respective second and third seats 13,113 and 14,114, defined on said insert 8,108, to prevent the accumulation of snow.

Conveniently, the interposition of the tab 12 of the insert 8 between the first flap 5 and the second flap 6 ensures a perfect tight seal which completely eliminates the infiltration of water inside the boot 2 by means of the tension applied by the securing elements.

Figure 7:
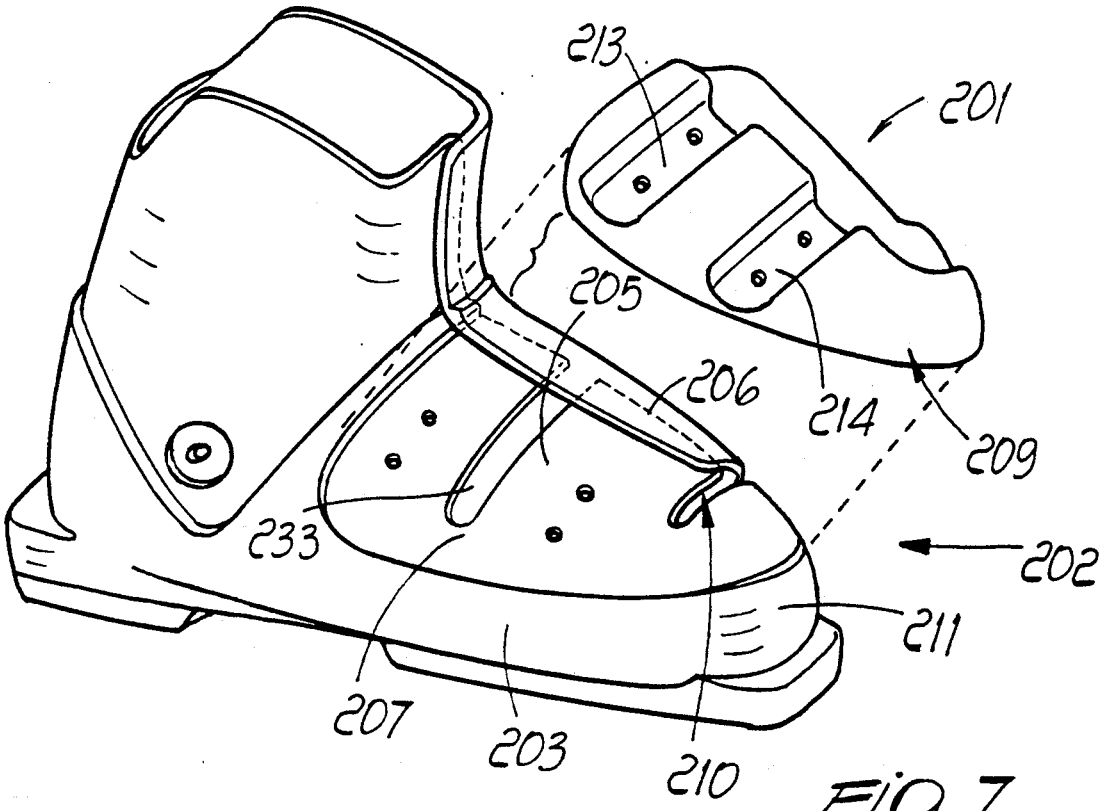
FIG. 7 is a partial exploded view of a ski boot having a device according to a further aspect of the invention.
Figure 8:
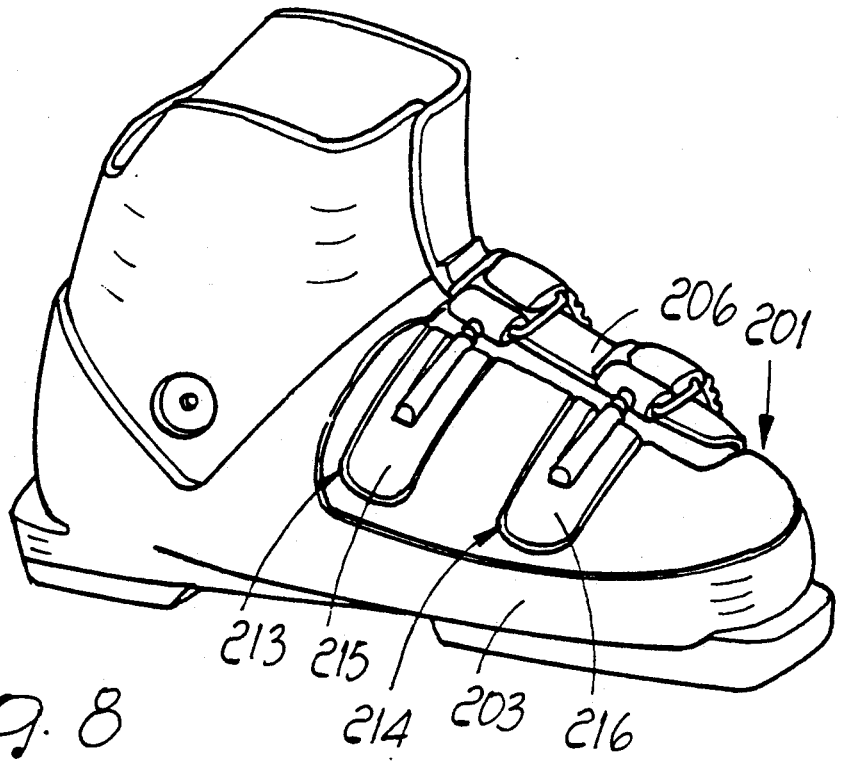
FIG. 8 is a partial perspective view of the boot of FIG. 7.

FIGS. 7–8 illustrate a boot 202 having a waterproof device 201 according to a further aspect of the invention.

Boot 202 has a shell 203 provided with a first seat 207 wherein an insert 208 is arranged.

First seat 207 is provided at a first flap 205 of shell 203 and a second flap 206 is adapted to overlap first flap 205.

Insert 208 is provided with second and third seats 213,214 respectively for a first 215 and a second 216 levers.

First flap 205 forms a slot 210 with the front tip 211 of the shell.

First flap 205 also has a second slot 233, formed approximately between levers 215,216, for easying the insertion of the foot in the boot.

Second slot 233 allows flap 205 to widen, when the boot is open, and to adapt to the shape of the foot.

It has thus been observed that the invention has achieved the above described aim and objects, optimum tightness to weather factors, such as snow or water, having been achieved.

The materials and the dimensions of the individual elements which constitute the structure may naturally be the most appropriate according to the specific requirements.

I claim:

1. Waterproof device for boots comprising a shell having a first recessed seat and having a first flap and a second flap which mutually overlap, characterized in that said device comprises an insert with is engaged in said first recessed seat of said shell, said insert having at least one containment seat for a lever and having a tab interposed between said first flap and said second flap.

2. Waterproof device for boots according to claim 1, wherein said insert has an outer lateral surface which is flush with a corresponding adjacent surface of said shell.

3. Waterproof device for boots according to claim 1, wherein said shell comprises at least one transverse slot which is completely concealed by said insert.

4. Waterproof device for boots according to claim 1, wherein said shell comprises a pair of transverse slots which are completely concealed by said insert.

5. Waterproof device for boots according to claim 1, wherein said insert comprises a pair of containment seats each of which accommodates a respective lever.

6. Waterproof device for boots comprising a quarter having a first recessed seat and having a first flap and a second flap which mutually overlap, characterized in that said device comprises an insert with is engaged in said first recessed seat of said quarter, said insert having at least one containment seat for a lever and having a tab interposed between said first flap and said second flap.

* * * * *